US012766595B2

(12) United States Patent
Hackl et al.

(10) Patent No.: US 12,766,595 B2
(45) Date of Patent: Oct. 20, 2026

(54) METHOD FOR MANUFACTURING A TOOL STEEL AS A SUPPORT FOR PVD COATINGS AND A TOOL STEEL

(71) Applicant: voestalpine BÖHLER Edelstahl GmbH & Co KG, Kapfenberg (AT)

(72) Inventors: Alfred Hackl, Kammern im Liesingtal (AT); Harald Leitner, Kindberg (AT)

(73) Assignee: voestalpine BÖHLER Edelstahl GmbH & Co KG, Kapfenberg (AT)

( * ) Notice: Subject to any disclaimer, the term of this patent is extended or adjusted under 35 U.S.C. 154(b) by 448 days.

(21) Appl. No.: 18/262,238

(22) PCT Filed: Jan. 20, 2022

(86) PCT No.: PCT/EP2022/051195

§ 371 (c)(1),
(2) Date: Jul. 20, 2023

(87) PCT Pub. No.: WO2022/157227

PCT Pub. Date: Jul. 28, 2022

(65) Prior Publication Data

US 2024/0307957 A1 Sep. 19, 2024

(30) Foreign Application Priority Data

Jan. 20, 2021 (DE) ..... 102021101105.1

(51) Int. Cl.
*B22F 3/15* (2006.01)
*B22F 3/24* (2006.01)
(Continued)

(52) U.S. Cl.
CPC ..... *B22F 3/15* (2013.01); *B22F 3/24* (2013.01); *C22C 38/001* (2013.01); *C22C 38/02* (2013.01);
(Continued)

(58) Field of Classification Search
CPC .... B22F 3/15; B22F 2998/10; B22F 2301/35; B22F 3/24; B22F 2003/248;
(Continued)

(56) References Cited

U.S. PATENT DOCUMENTS 5,435,827 A * 7/1995 Wisell ..... C22C 33/0257 420/105
2005/0002819 A1* 1/2005 Schemmel ..... C22C 38/30 420/107
(Continued)

FOREIGN PATENT DOCUMENTS

AT 412000 B 8/2004
EP 1471160 A1 10/2004
(Continued)

OTHER PUBLICATIONS

International Search Report and Written Opinion for PCT Application No. PCT/EP2022051195, mailed May 4, 2022; 18 pages.

*Primary Examiner* — Nicholas A Wang

(57) ABSTRACT

A tool steel as well as a method for manufacturing a tool steel for cold-work and/or high-speed-work applications, in particular as an intermediate product for manufacturing cold-work and/or high-speed-work tools with a PVD coating, consisting of the following alloying elements: (all amounts expressed in wt %):

C=0.55 to 0.75
Si=0.70 to 1.00
Mn=0.20 to 0.50
Cr=4.00 to 5.00
Mo=1.80 to 3.50
V=0.80 to 1.50
W=1.80 to 3.00
Co=3.00 to 5.00
N=0.02 to 0.10
and optionally one or more of
(Continued)

| Wt% | C | Si | Mn | Cr | Mo | V | W | Co | N | Fe |
|---|---|---|---|---|---|---|---|---|---|---|
| Upper limit according to the invention | 0.75 | 1.00 | 0.60 | 5.00 | 3.50 | 1.50 | 3.00 | 5.00 | 0.10 | balance |
| Preferred upper limit | 0.68 | 0.94 | 0.40 | 4.70 | 3.20 | 1.25 | 2.70 | 4.30 | 0.08 | balance |
| Possible embodiment | 0.63 | 0.88 | 0.27 | 4.23 | 2.74 | 1.12 | 2.40 | 3.70 | 0.05 | balance |
| Preferred lower limit | 0.58 | 0.70 | 0.22 | 4.10 | 2.00 | 0.90 | 2.00 | 3.50 | 0.03 | balance |
| Lower limit according to the invention | 0.55 | 0.70 | 0.20 | 4.00 | 1.80 | 0.80 | 1.80 | 3.00 | 0.02 | balance |

Ni≤1.5
Cu≤1.0
Ti≤1.5
Nb≤1.5
Ta≤1.5
Hf≤1.5
Zr≤1.5
Al≤1.5
B≤0.8
S≤0.35
P≤0.35
and residual iron and inevitable smelting-related impurities.

5 Claims, 9 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/22*** | (2006.01) |
| ***C22C 38/24*** | (2006.01) |
| ***C22C 38/30*** | (2006.01) |

(52) U.S. Cl.
CPC ..... *C22C 38/04* (2013.01); *C22C 38/22* (2013.01); *C22C 38/24* (2013.01); *C22C 38/30* (2013.01); *B22F 2003/248* (2013.01); *B22F 2301/35* (2013.01); *B22F 2998/10* (2013.01); *B22F 2999/00* (2013.01)

(58) Field of Classification Search
CPC .. B22F 2999/00; B22F 2005/001; B22F 1/05; B22F 1/052; B22F 10/28; B22F 10/36; B22F 10/64; B22F 10/66; B22F 2304/10; B22F 3/225; B22F 2003/242; B22F 2003/247; B22F 2009/0824; B22F 2201/02; B22F 3/17; B22F 5/04; C22C 38/001; C22C 33/0264; C22C 38/02; C22C 38/04; C22C 38/44; C22C 38/46; C22C 38/48; C22C 38/50; C22C 38/54; C22C 33/0257; C22C 38/22; C22C 38/24; C22C 38/26; C22C 38/28; C22C 38/30; C22C 38/32; C22C 38/42; C22C 1/1042; C22C 33/0278; C22C 33/0292; C22C 38/002; C22C 38/06; C22C 38/52; C22C 33/0285; C22C 38/60; C21D 1/18; C21D 6/02; C21D 6/001; C21D 6/002; C21D 6/004; C21D 6/005; C21D 6/007; C21D 6/008; C21D 1/25; C21D 1/74; C21D 1/76; C21D 1/773; C21D 1/785; C21D 8/005
See application file for complete search history.

(56) References Cited

U.S. PATENT DOCUMENTS

2005/0161125 A1* 7/2005 Ozaki ..... C22C 38/04 148/334
2008/0253919 A1* 10/2008 Theisen ..... C22C 38/48 420/12

FOREIGN PATENT DOCUMENTS

| | | | | |
|---|---|---|---|---|
| EP | 1469094 | B1 | | 1/2008 |
| EP | 2064361 | B1 | | 3/2014 |
| EP | 3315617 | A1 | | 5/2018 |
| EP | 3050986 | B1 | | 7/2019 |
| JP | 2016060961 | A | | 4/2016 |
| WO | 9302818 | A1 | | 2/1993 |
| WO | 2010044740 | A1 | | 4/2010 |
| WO | WO2010044740 | | * | 4/2010 |

* cited by examiner

| Wt% | C | Si | Mn | Cr | Mo | V | W | Co | N | Fe |
|---|---|---|---|---|---|---|---|---|---|---|
| Upper limit according to the invention | 0.75 | 1.00 | 0.60 | 5.00 | 3.50 | 1.50 | 3.00 | 5.00 | 0.10 | balance |
| Preferred upper limit | 0.68 | 0.94 | 0.40 | 4.70 | 3.20 | 1.25 | 2.70 | 4.30 | 0.08 | balance |
| Possible embodiment | 0.63 | 0.88 | 0.27 | 4.23 | 2.74 | 1.12 | 2.40 | 3.70 | 0.05 | balance |
| Preferred lower limit | 0.58 | 0.70 | 0.22 | 4.10 | 2.00 | 0.90 | 2.00 | 3.50 | 0.03 | balance |
| Lower limit according to the invention | 0.55 | 0.70 | 0.20 | 4.00 | 1.80 | 0.80 | 1.80 | 3.00 | 0.02 | balance |

| Wt% | C | Si | Mn | Cr | Mo | V | W | Co | N | Fe |
|---|---|---|---|---|---|---|---|---|---|---|
| Invention | 0.63 | 0.88 | 0.27 | 4.23 | 2.74 | 1.12 | 2.41 | 3.70 | 0.14 | balance |
| Ref. 1 | 0.52 | 0.16 | 0.48 | 4.13 | 1.96 | 1.15 | 1.56 | 0.77 | 0.28 | balance |
| Ref. 2 | 0.52 | 0.24 | 0.48 | 4.17 | 1.96 | 1.15 | 1.50 | 0.78 | 0.26 | balance |

| | Hardening [T, t] | Tempering [T, t] |
|---|---|---|
| Upper limit according to the invention | 1180 °C / 2 min | 560 °C / 3x 3.0 h |
| Preferred upper limit | 1160 °C / 3 min | 550 °C / 3x 2.5 h |
| Possible embodiment | 1150 °C / 3 min | 530 °C / 3x 2.0 h |
| Preferred lower limit | 1140 °C / 3 min | 530 °C / 3x 2.0 h |
| Lower limit according to the invention | 1100 °C / 20 min | 530 °C / 2x 1.5 h |

Fig. 7

| Ex. | Hardening temperature [°C] | MC area fraction [%] | M6C area fraction [%] |
|---|---|---|---|
| 50 | 1070 | 1.59 | 2.62 |
| 3 | 1150 | 1.33 | 2.45 |
| 51 | 1030 | 1.51 | 3.43 |

Fig. 8

| Carbide type | Quantity | Quantity per $mm^2$ | Area fraction [%] | Ø ECD [µm] | Max. ECD [µm] |
|---|---|---|---|---|---|
| M6C | 763 | 27538 | 1.9 | 0.9 | 2.1 |
| MC | 1104 | 39845 | 1.3 | 0.6 | 1.5 |

Fig. 9

| Ex. | Hardness measurements [HRC] | Hardness average [HRC] | E [Gpa] | Rp0.05 [MPa] | Rp0.01 [MPa] | Rp0.02 [MPa] |
|---|---|---|---|---|---|---|
| 3-1 | 64.6 / 64.8 / 64.8 | 64.7 | 227 | 2560 | 2770 | 2966 |
| 3.2 | 64.4 / 64.5 / 64.5 | 64.5 | 224 | 2577 | 2773 | 2975 |

Fig. 15

| Ex. | C | Si | Mn | Cr | Mo | V | W | Co | Ni | N | Fe |
|---|---|---|---|---|---|---|---|---|---|---|---|
| 1 | 0.61 | 0.85 | 0.35 | 4.58 | 2.71 | 1.15 | 2.51 | 3.64 | 0.17 | 0.05 | balance |
| 2 | 0.61 | 0.88 | 0.31 | 4.21 | 2.51 | 1.05 | 2.32 | 3.54 | 0.11 | 0.04 | balance |
| 3 | 0.63 | 0.88 | 0.27 | 4.23 | 2.74 | 1.12 | 2.41 | 3.70 | 0.14 | 0.05 | balance |
| 4 | 0.68 | 0.85 | 0.33 | 4.31 | 2.85 | 1.21 | 2.53 | 3.67 | 0.32 | 0.07 | balance |
| 5 | 0.75 | 0.79 | 0.38 | 4.81 | 2.49 | 1.51 | 2.43 | 4.01 | 0.25 | 0.04 | balance |

| Ex. | Hardening [T, t] | Tempering [T, t] | Hardness [HRC] | SB [J] | Rp0.2 [MPa] |
|---|---|---|---|---|---|
| 1 | 1150 °C / 3 min | 560 °C / 3x 2 h | 62.5 | 79 | 2809 |
| 2 | 1120 °C / 6 min | 530 °C / 3x 2 h | 63.5 | 81 | 2853 |
| 3 | 1150 °C / 3 min | 530 °C / 3x 2 h | 64.7 | 75 | 2971 |
| 4 | 1150 °C / 3 min | 530 °C / 3x 2 h | 65.5 | 62 | 2985 |
| 5 | 1150 °C / 3 min | 530 °C / 3x 2 h | 66.0 | 53 | 3027 |

Fig. 16

| Ex. | C | Si | Mn | Cr | Mo | V | W | Co | N | Fe | Hardness [HRC] | SB [J] | Rp0.2 [MPa] |
|---|---|---|---|---|---|---|---|---|---|---|---|---|---|
| 52 | 0.46 | 0.91 | 0.35 | 4.58 | 2.95 | 1.36 | 2.65 | 3.69 | 0.05 | balance | 58 | 80 | 2456 |
| 53 | 0.57 | 0.24 | 0.25 | 4.27 | 2.74 | 1.15 | 2.32 | 3.73 | 0.04 | balance | 58 | 75 | 2419 |
| 54 | 0.56 | 0.88 | 0.27 | 4.21 | 2.64 | 1.12 | 2.21 | 3.22 | 0.14 | balance | 64 | 58 | 2771 |
| 55 | 0.81 | 0.69 | 0.40 | 4.20 | 2.71 | 1.20 | 2.35 | 3.01 | 0.04 | balance | 65 | 31 | 2901 |
| 56 | 0.58 | 0.64 | 0.31 | 4.20 | 2.22 | 1.23 | 2.18 | 5.12 | 0.04 | balance | 65 | 21 | 2920 |
| 57 | 0.63 | 0.89 | 0.27 | 4.24 | 2.74 | 1.19 | 2.49 | 1.03 | 0.05 | balance | 60 | 81 | 2524 |

Fig. 17

METHOD FOR MANUFACTURING A TOOL STEEL AS A SUPPORT FOR PVD COATINGS AND A TOOL STEEL

TECHNICAL FIELD

The invention relates to a method for manufacturing a tool steel as a support for PVD coatings, a method for manufacturing a high-pressure-resistant tool, such as a stamping tool, which is coated with a PVD coating. The invention also relates to a steel material as a support for PVD coatings, a high-strength tool such as a stamping tool, which is coated with a PVD coating, and a use of the steel material as a support for PVD coatings.

DESCRIPTION OF RELATED ART

Known tool steels today cover a wide range of applications. High-speed steels and modern cold-work steels are used in many areas and often have a very high hardness level as well as sufficient toughness. Such steels are used, for example, for tools that remove material by drilling, milling, or cutting. A high level of hot hardness is required especially for high-speed work applications, since these application areas lead not only to powerful heating of the workpiece, but also to very powerful heating of the tool. In this respect, it is important for these steels to retain their mechanical properties even at potentially achievable higher working temperatures. But such steels are also subjected to high pressures in many cold-work applications, so that a high compressive strength is also required. This applies, for example, to fine blanking and stamping, so that compressive strength is needed here to prevent premature chipping.

In particular, such steels are used as active elements in the area of stamping and fine blanking, which in addition to a high compressive load should also withstand wear due to abrasion.

The hardness level and fatigue strength of the tool can also be increased by means of a suitable coating. In recent years, there have been significant advances in hard coatings of tool steels. This involves coating the surface of the tool with a high-strength hard material. This increases the wear resistance and the service life of the tool and thus reduces the requirements for tool steels in many application areas.

However, the use of such hard coatings requires a support material with high compressive strength since otherwise the "eggshell effect" can occur due to Hertzian contact stress, for example. This occurs when there is a large difference in hardness between the support material and the hard coating. In this case, the hard coating collapses because the soft substrate yields. Tools of this kind must withstand high pressures when used. A support material with a high pressure strength increases the effect of the hard coating and thus results in an overall improvement in the performance of the tool.

It is known to coat such tool steels by means of PVD technology. Common coating materials, particularly for producing hard coatings, are for example DLC coatings (diamond-like carbon), metal oxides ($Al_2O_3$), nitrides (AlCrN, AlTiN, AlCrSiN, . . . ), and carbonitrides (TiCN, . . . ) as well as alternating coating systems, in particular composed of titanium, aluminum, and chromium as well as mixtures of these metals.

It is also desirable for high-strength tool steels to have sufficient toughness to achieve long tool life and particularly to avoid brittleness that can lead to premature tool damage.

In addition, it is desirable for such steels or tools to have a high fatigue strength.

It is known to use cold-work steels for manufacturing high strength tools. Known cold-work steels featured by a high carbide content, which gives the steel a high hardness. A high carbide content also results in high wear resistance to both abrasion and adhesion.

Known high-strength, high-performance tool steels for high-speed work applications and cold-work applications include alloys that in addition to iron, contain, for example, 0.8-2.4% carbon, 4-8% chromium, 2-5% molybdenum, 2-9% vanadium, 1-15% tungsten, and up to 12% cobalt.

The essential content of these elements is to ensure high hardness, which is ensured on the one hand by the carbon, which allows the formation of carbides, these carbides being formed with the alloying elements chromium, molybdenum, tungsten, and vanadium.

In carbide formation, there is a distinction between primary, secondary, and secondary hardening carbides. The primary carbides are precipitated from the liquid phase during cooling. The nucleation in the liquid phase is rapid and the growth of the carbides is accelerated and leads accordingly to large carbide particles with a size of about 15 μm. The primary carbides occur more frequently in the segregation zones because the concentration of carbide-forming elements is higher there. During a subsequent heat treatment, the segregation zones are partially degraded and the primary carbides are dissolved.

Secondary carbides are precipitated from the solid phase below the solidus temperature. They are usually smaller than the primary carbides and have a size of 1-2 μm. The secondary carbides are formed, for example, from the alloying elements tungsten, molybdenum, and vanadium and can exist in the form of MC or $M_6C$ carbides, among others.

Secondary hardening carbides are formed during heat treatment, in particular during tempering at approx. 500° C., in that carbide-forming elements still dissolved in the matrix combine with carbon. The secondary hardening carbides are very small and have a size of approx. 100 nm.

It is known that carbides represent defects in the matrix, which can have a crack-initiating effect. This primarily reduces the toughness level of the steel. Steels with very high carbide contents are therefore brittle and good toughness is difficult to achieve.

The parameters of hardness and toughness cannot both be increased at will at the same time. As is known to the person skilled in the art, very high hardness often results in low toughness. The low toughness observed in steels with high carbide contents leads to premature tool failure in certain applications.

A high carbide content is the main adjusting mechanism for achieving the desired high hardness of a cold-work steel. The accompanying reduction in toughness is considered an acceptable trade-off. Another option for increasing the hardness of the steel is to strengthen the steel matrix. This involves so-called matrix steels, which by definition contain no carbides. The known matrix steels exhibit good fracture toughness and improved fatigue behavior. The hardness level of such carbide-free steels, however, is limited to at most 56-58 HRC. Higher hardness levels require carbides distributed in the steel. Matrix steels also feature comparatively low wear resistance.

It is known that certain high-alloy steel grades which have a particularly high hardness can no longer be readily produced via conventional manufacturing routes such as ingot casting and subsequent forming such as forging, rolling, or the like, because of the powerful segregation tendency and the non-homogeneous carbide distribution, which reduce the toughness too much for use.

For these steel grades, it has become established practice to use powder metallurgy manufacturing, in which liquid steel is broken down into a powder in a gas stream (atomization) and this powder is then compacted and shaped, in particular by means of hot isostatic pressing.

EP 1 469 094 B1 has disclosed a high-speed steel that has a hardness of 57 HRC, which is achieved by a high content of carbide-forming elements such as vanadium, molybdenum, and tungsten. The carbide particles have an average diameter of 0.5 μm and a density of more than 80 to 103 particles/$mm^2$. The carbide particles are formed during diffusion annealing at 1300° C. for 10 h to 20 h and rapid cooling to 900° C. at a cooling speed of at least 3° C./min, followed by heating to 1100° C. for no longer than 10 h.

EP 3 050 986 B1 has disclosed a high-speed steel that has a relatively high hardness of 45-60 HRC, which is due to a high carbide concentration. The carbide precipitates are particles with a maximum size of 1 μm and an average diameter of 0.5 μm. The heat treatment corresponds to the heat treatment known from EP 1 469 094 B1. But in the alloy composition, the nitrogen content is greatly reduced and is at most 0.018% in order to reduce the formation of carbonitrides and thereby increase the toughness.

EP 3 315 617 A1 has disclosed a high-speed steel that has a maximum hardness of 69 HRC and the following alloy composition in wt %: 0.5-2.2 C, 0.1-1.0 Si, 0.1-1.0 Mn, 0.025 P, ≤0.0040 S, 3.0-7.0 Cr, 5.0-30.0 W+2Mo, 0.6-5.0 V, 10 Co, ≤0.3 Al, 0.015 Ca, 0.0100 N, and 0.0040 O (oxygen). The steel matrix contains MC and $M_6C$ carbides of at least 0.4 μm, with an area fraction of at least 3.8% and 6.8%, respectively. The high area fraction of large carbide particles serves to increase the wear resistance, which is $0.370\times10^{-7}$ $mm^3$/kg for the above-mentioned alloy composition.

In order to achieve high hardness, relatively high carbide contents are produced in the known tool steels. In addition, the carbide particles are relatively large. Since it is known that carbides can constitute defects in the matrix, the toughness of the steel material is severely limited. In many applications, this results in cracks and premature failure of the steel material.

The object of the invention is to create a method for manufacturing a tool steel as a support for PVD coatings, which has a high hardness level of at least 62 HRC and also has a high compressive strength in the form of an offset yield point Rp0.2 of at least 2700 MPa.

Another object of the invention to create a tool steel as a support for PVD coatings, which has a high hardness level of at least 62 HRC and also has a high offset yield point Rp0.2 of at least 2700 MPa.

SUMMARY OF THE INVENTION

According to the invention, a hybrid steel has been developed, which has a high hardness level of known carbide-containing cold-work steels and at the same time, a high toughness of known matrix steels. In addition, the steel material according to the invention features a high offset yield point Rp0.2. This creates a steel material that is outstandingly suitable as a support for subsequent PVD coatings and consequently for the manufacture of a stamping tool in particular.

According to the invention, the carbide content is reduced compared to known steel grades with a comparable hardness level. These are secondary carbides, which are precipitated from the solid phase and have a small carbide size. The carbides contained are round and homogeneously distributed. In addition, the steel material according to the invention does not contain any primary carbides. Surprisingly, a high hardness level and a high compressive strength (offset yield point) are nevertheless achieved, with a significant increase in toughness. This is achieved with a powder metallurgy manufacturing route, a balanced alloy composition, and a heat treatment that is fine-tuned to it.

Wherever percentages are indicated below, they are always percentages by weight (weight percent or mass percent), unless otherwise indicated.

The alloy according to the invention consists of the following elements:

| Elements | Weight % | Preferable wt % |
|---|---|---|
| Carbon (C) | 0.55-0.75 | 0.58-0.68 |
| Silicon (Si) | 0.70-1.00 | 0.70-0.94 |
| Manganese (Mn) | 0.20-0.60 | 0.20-0.40 |
| Chromium (Cr) | 4.00-5.00 | 4.10-4.70 |
| Molybdenum (Mo) | 1.80-3.50 | 2.00-3.20 |
| Vanadium (V) | 0.80-1.50 | 0.90-1.25 |
| Tungsten (W) | 1.80-3.00 | 2.00-2.70 |
| Cobalt (Co) | 3.00-5.00 | 3.50-4.30 |
| Nitrogen (N) | 0.02-0.10 | 0.03-0.08 |
| and optionally one or more of | | |
| Nickel (Ni) | ≤1.5 | ≤0.35 |
| Copper (Cu) | ≤1.0 | ≤0.1 |
| Titanium (Ti) | ≤1.5 | ≤0.3 |
| Niobium (Nb) | ≤1.5 | ≤0.5 |
| Tantalum (Ta) | ≤1.5 | ≤0.3 |
| Hafnium (Hf) | ≤1.5 | ≤0.3 |
| Zirconium (Zr) | ≤1.5 | ≤0.3 |
| Aluminum (Al) | ≤1.5 | ≤0.3 |
| Boron (B) | ≤0.8 | ≤0.006 |
| Sulfur (S) | ≤0.35 | ≤0.05 |
| Phosphorus (P) | ≤0.35 | ≤0.05 |

and residual iron and alloying impurities.

In general, it can be stated that the alloying elements in such steels function as follows:

Carbon [C]:

Carbon is essentially used to set the desired hardness level. But the carbon content should not be too high since this can lead to a high proportion of precipitates in the form of carbides, which could have a negative effect on toughness and fatigue strength. The upper limit according to the invention is therefore 0.75 wt %, preferably 0.68 wt %, particularly preferably 0.63 wt %. To reliably bring the hardness to a desired level, the lower limit according to the invention is 0.55 wt %, preferably 0.58 wt %. Below 0.55 wt %, the desired hardness level is not achieved. Above 0.75 wt %, primary carbides can form, which reduces the toughness.

Silicon [Si]:

Si is a solid solution hardener and in steels, is not a carbide-forming element, but influences the carbide precipitation kinetics in the steel. It stabilizes the carbon so that it is only available for carbide formation at higher temperatures. Silicon serves as a deoxidizing agent and is therefore present in low concentrations in almost all steels for production-related reasons. It increases scale resistance, yield strength, and tensile strength without significantly reducing elongation. On the other hand, a decrease in silicon content leads to a reduction in the anisotropy of the mechanical properties. A low silicon content allows the initial formation of metastable $M_3C$ carbides. These act as a C reservoir for the subsequent precipitation of the desired MC carbides. It also suppresses the formation of undesirable $M_{23}C_7$ carbides at grain boundaries. But a Si content that is too high can significantly reduce toughness. The upper limit according to the invention is therefore 1.00 wt %, preferably 0.94 wt %, particularly preferably 0.88 wt %. The lower limit according to the invention is 0.70 wt %. Below 0.70 wt %, the desired hardness cannot be reliably achieved.

Manganese [Mn]:

Although manganese can influence the hardening behavior of the material, it is primarily seen together with the sulfur content, with sulfur and manganese being regarded as elements that improve the machinability of the steel as a result of sulfide inclusion formation. In addition, like silicon, manganese functions as a solid solution strengthener. This element increases hardness, but a proportion that is too high can lead to a reduction in toughness. The upper limit according to the invention is therefore 0.60 wt %, preferably 0.50 wt %, more preferably 0.40 wt %, particularly preferably 0.27 wt %. The lower limit according to the invention is 0.20 wt %, preferably 0.22 wt %.

Chromium [Cr]:

Chromium in a proportion greater than 4.00 wt % results in the desired solid solution strengthening. In general, chromium lowers the critical cooling speed and thus increases hardenability. The addition of chromium to the alloy is important for through-hardenability, so that it is also possible to harden tools of larger dimensions. Increased chromium contents can also result in carbide precipitation of the $M_7C_3$ type and thus increase the hardness. Excessively high chromium contents can thus also result in negative effects with regard to toughness. In addition, excessively high chromium contents of greater than 5.00 wt % can result in negative effects on the retained austenite content during hardening. The upper limit according to the invention is therefore 5.00 wt %, preferably 4.70 wt %, particularly preferably 4.23 wt %. For the reasons mentioned above, the lower limit according to the invention is 4.00 wt %, preferably 4.10 wt %.

Molybdenum [Mo]:

Molybdenum forms special carbides and, on the other hand, forms mixed carbides with iron. These are of the $M_2C$, $M_6C$, and MC types. The addition of molybdenum increases the activation energy for the C diffusion in the austenite and thus reduces both the diffusion coefficient for C and the C diffusion. This results in a lower bainite starting temperature (Bs) and a reduced bainite formation. On the other hand, an addition of Mo leads to refinement of the microstructure, i.e. a fine structure prevails regardless of the cooling rate (1° C./s to 60° C./s). Grain coarsening remains low due to the low solution rate and high solution temperature of carbides (carbides counteract grain coarsening). Improved tempering resistance can thus be achieved by austenitizing (solution annealing) at higher hardening temperatures since more carbide-forming elements can be precipitated and thus more carbides are formed. The hard carbides also increase the hot yield strength and wear resistance. At high working temperatures, Mo improves the scale resistance of the steel. Excessively high contents diminish the machinability and, in the event that it remains dissolved in the matrix, the thermal conductivity. Embrittlement could also occur during tempering due to the former austenite grain boundaries being occupied by carbides. The upper limit according to the invention is therefore 3.50 wt %, preferably 3.20 wt %, particularly preferably 2.74 wt %. For the reasons mentioned above, the lower limit according to the invention is 1.80 wt %, preferably 2.00 wt %. Molybdenum can be entirely or partly replaced by tungsten according to $W_{eq}$=W+2Mo.

Vanadium [V]:

Vanadium is one of the strongest carbide-forming elements, along with Nb and Ti, due to its high affinity for C. It forms fine and uniformly distributed MC-type precipitates during tempering. These are preferred because of their higher thermal resistance compared to other carbide types. This results in an increase in the high temperature strength, an increase in yield strength and wear resistance, and an improvement in the tempering resistance. But at higher concentrations, a higher hardening temperature is required to dissolve the thermally stable primary MC carbides. The upper limit according to the invention is therefore 1.50 wt %, preferably 1.25 wt %, particularly preferably 1.12 wt %. For the reasons mentioned above, the lower limit according to the invention is 0.80 wt %, preferably 0.90 wt %.

Cobalt [Co]:

Cobalt is an austenite-stabilizing element. It does not form carbides, but remains dissolved in the matrix and thus influences the carbon diffusion. This leads to an increase in hot hardness, improved hot embrittlement, and the high matrix hardness according to the invention, which manifests itself in a high offset yield point Rp0.2. Excessively high contents can limit toughness; the upper limit according to the invention is therefore 5.00 wt %, preferably 4.30 wt %, particularly preferably 3.70 wt %. According to the invention, the lower limit is 3.00 wt %, preferably 3.50 wt %.

Nitrogen [N]:

Nitrogen usually forms nitrides and carbonitrides, which increase the hardness and wear resistance of the steel alloy. The nitride and carbonitride particles are relatively large because they are already formed in the melt. Excessive nitrogen can thus reduce toughness and promote intergranular stress corrosion. More than 0.10 wt % nitrogen can adversely affect toughness. Since the steel material is usually atomized with $N_2$ to form powder, small traces of nitrogen are present for production-related reasons. Since few nitride formers (Al, Ti, Nb) are added to the alloy, no nitrides are formed and instead, N remains interstitially dissolved and increases the hardness of the matrix, which consists of martensite. Less than 0.02 wt % nitrogen would be insufficient for the desired hardness and wear resistance. The upper limit according to the invention is therefore 0.10 wt %, preferably 0.80 wt %, particularly preferably 0.5 wt %. According to the invention, the lower limit is 0.02 wt %, preferably 0.03 wt %, particularly preferably 0.04 wt %.

Tungsten [W]:

Tungsten is a ferrite-stabilizing element. It is a strong carbide former and is used to increase wear resistance. The addition of tungsten improves hot hardness and temper resistance, so it is used as an additive in high-speed steel and hot-work tool steel. But tungsten is also a costly alloying element. Tungsten can be entirely or partly replaced by molybdenum according to $W_{eq}$=W+2Mo. The upper limit according to the invention is 3.00 wt %, preferably 2.70 wt %, particularly preferably 2.40 wt %. According to the invention, the lower limit is 1.80 wt %, preferably 2.00 wt %.

Tungsten Equivalent [$W_{eq}$]:

The tungsten equivalent $W_{eq}$, which is defined as W+2Mo, indicates the hot hardness and tempering resistance as well as a measurement of the structure. According to the invention, the $W_{eq}$ should be less than 10.0 wt %, preferably less than 9.1 wt %, since otherwise, the toughness is reduced and the susceptibility to brittle fracture increases. Preferably this value is between 7.5 and 8.2 wt %, especially 7.9 wt %, since this can be advantageous for machinability as well as hot hardness. The $W_{eq}$ should not be less than 5.4 wt %. In addition, this setting of the $W_{eq}$ can also positively influence the structure since the carbide content is high enough to achieve a high hardness level and outstanding wear resistance and at the same time is not unnecessarily high, which would negatively influence the toughness.

Nickel [Ni]:

Nickel is one of the alloying elements that promote solidification according to the stable iron-carbon system. By reducing the critical cooling speed, nickel increases through-hardening and through-tempering. Nickel also increases toughness, especially in the low-temperature range, has a grain-refining effect, and reduces sensitivity to overheating. High nickel contents result in small or, in some cases, negative thermal expansion coefficients. For the reasons mentioned above, the upper limit according to the invention is 1.50 wt %. Preferably, the upper limit of the nickel content can also be selected to be 1.00, particularly preferably 0.35 or 0.30 or 0.27 or 0.25 wt %. Nickel can also be present merely as a production-related impurity, i.e. without deliberate addition to the alloy. The lower limit can be 0.04 wt %.

Niobium [Nb]:

Niobium functions similarly to vanadium and forms MC type carbides. But niobium results in a more angular shape of MC carbides so the maximum addition is limited to 1.5 wt %, preferably 0.5 wt %. Since Nb forms nitrides that can impair atomization due to "clogging," the upper limit can be 0.21 wt %, particularly preferably 0.11 wt %. The lower limit can be 0.002 wt %. Preferably, no niobium is added.

Copper [Cu]:

Copper is an optional element that can contribute to an increased hardness. If used, the preferred range is up to 1.00 wt %, particularly preferably up to 0.1 wt %. But it is difficult to recycle Cu-containing steel, so copper is not usually intentionally added. A technically feasible lower limit can be 0.006 wt %.

Titanium [Ti], zirconium [Zr], hafnium [Hf], tantalum [Ta]:

These elements are carbide formers. For all of them, the preferred range is 0.02-1.50 wt %. A particularly preferred upper limit is 0.3 wt %. Typically, however, none of these elements is added. The lower limit can be 0.005 wt %. Since Ti can likewise form nitrides that can impair atomization by "clogging," the Ti upper limit can be a particularly preferred 0.18 wt %, especially preferably 0.09 wt %.

Aluminum [Al]:

Aluminum is used as a deoxidizing agent. The upper limit can be 1.5 wt %, preferably 0.3 wt %. Since Al forms nitrides that can impair atomization by "clogging," the upper limit can be 0.18 wt %, particularly preferably 0.09 wt %. A technically feasible lower limit can be 0.005 wt %.

Boron [B]:

Boron can increase the hardness of the steel material. The boron content is limited to 0.8 wt %, preferably ≤0.006 wt %. The lower limit can be 0.0002 wt %.

Phosphorus [P]:

Phosphorus tends to diffuse to grain boundaries and weaken grain cohesion. Phosphorus is therefore limited to ≤0.35 wt %, preferably to ≤0.05 wt %. A technically feasible lower limit can be 0.001 wt %.

Sulfur [S]:

Sulfur contributes to better machining. But high S contents can have a negative effect on toughness. Sulfur is therefore limited to ≤0.35 wt %, preferably to ≤0.05 wt %. A technically feasible lower limit can be 0.001 wt %.

In a preferred embodiment, the tool steel satisfies the following formula (1):

$$0.005 \leq 0.8[\mathrm{Nb}] + [\mathrm{Ti}] + [\mathrm{Al}] \leq 0.18$$

where [Nb], [Ti], and [Al] represent the contents of Nb, Ti, and Al in wt %. Too much of these elements can lead to "clogging" during atomization and degrade the powder properties; for this reason, the upper limit can be 0.18 wt %.

In a preferred embodiment, the tool steel satisfies the following formula (2):

$$2.7 \leq 1/2[\mathrm{Mo}] + [\mathrm{W}] \leq 4.5$$

where [Mo] and [W] represent the contents of Mo and W in wt %. This results in particularly advantageous, uniformly finely distributed carbides, since no primary carbides are formed, but the carbides are produced as secondary carbides from the solid phase.

In a preferred embodiment, the tool steel satisfies the following ratio (3):

$$0.5 \leq [C]/[V] \leq 0.6$$

where [C] and [V] represent the contents of C and V in wt %. Outside this ratio, a formation of primary carbides of the MC type can occur, which reduces toughness.

In a preferred embodiment, the tool steel satisfies the following ratio (4):

$$8.2 \leq (VM * HM)/(VS * HS) = 13.5$$

where VM is the volume fraction of the matrix, HM is the hardness of the matrix in HV (Vickers hardness), VS is the volume fraction of the secondary carbides, and HS is the hardness of the secondary carbides. With the heat treatment of the alloy according to the invention, this ratio can be achieved. For example, the heat treatment of Example 3 results in a VM of 96.22 vol % with an HM of 830 HV as well as a VS of 3.78 vol % and an HS of 8.8 with a mixed hardness (=proportional hardness of the MC and $M_6C$ carbides) of 2400 HV. If this ratio is undershot, i.e. excessive carbides are formed, then the toughness can decrease. If this ratio is exceeded, i.e. insufficient carbides are formed, then a coarsening of the grains can occur during the hardening, i.e. excessive grain growth. The hardness in HV is determined in accordance with DIN EN ISO 6507-1.

According to the invention, the steel material is preferably processed by powder metallurgy. In this manufacturing route, a steel melt is generally atomized to powder. This powder is dispensed into a capsule, welded airtight, and then hot isostatic pressed (HIP process).

This already dense and homogeneous material is formed, for example by rolling or forging, and then soft annealed. Annealing is used for a further processing of the steel material, such as a subsequent surface treatment or the like. Then a heat treatment is carried out. This can also be done by the customer, for example after the tool has been manufactured. To do so, the steel material or tool is brought to a temperature range of 1100-1180° C., with the holding time being selected as a function of the temperature. The holding time begins at the point when the steel material has been heated through, i.e. the desired temperature has also been reached in the core. After the designated holding time, the steel material is subjected to rapid cooling, in particular with a λ value≤3, in particular between 0.08 and 3. Higher λ values can result in the occurrence of undesirable intermediate stage structures, resulting in a decrease in hardness. Lower λ values would be possible, for example by means of water quenching, but are not common. Then a tempering treatment is carried out, in which the steel is tempered several times for 120 min in a temperature range between 530° C. and 560° C.

In the steel alloy according to the invention, the carbide content is lowered, namely into a range in which the person skilled in the art would expect a significantly reduced hardness level and a reduced compressive strength. In addition, the nitrogen content is raised and is now significantly higher than in known steel grades. The person skilled in the art would expect a reduced toughness level in this range. According to the invention, however, it has been discovered that despite the reduction in carbide content and the increase in nitrogen content, the above effects surprisingly do not occur and thus a high hardness combined with high toughness is achieved.

The alloy according to the invention achieves a hardness of at least 62 HRC, preferably at least 63 HRC, measured in accordance with ASTM E18-17, with a high toughness of at least 73 J of impact bending work at room temperature, measured in accordance with SEP 1314. In addition, the alloy according to the invention exhibits a high compressive strength, expressed as the offset yield point Rp0.2, of at least 2700 MPa, preferably 2800 MPa, more preferably 2900 MPa, particularly preferably 2950 MPa, determined by the uniaxial compression test in accordance with ASTM E606. Due to the high hardness, the compressive strength was not determined by means of common cylinder compression tests, but by means of the uniaxial compression test as part of an LCF test (low cycle fatigue) in accordance with ASTM E606; the test was carried out with the following parameters: testing machine: servo-hydraulic Instron 8854, 250 kN load cell, strain gauge is a laser extensometer made by Fiedler; specimen type: LCF specimen with shortened shaft; specimen size: 12 mm initial length $L_0$, 9 mm diameter; test speed 0.00025 RPS, strain controlled; test at room temperature. This is the strain-controlled loading of the first cycle of the LCF test.

According to the invention, it has been discovered that an optimum in terms of hardness and toughness can be achieved in the narrow alloy window according to the invention and with increased nitrogen content, particularly when the heat treatment according to the invention is carried out. It has been discovered that in particular, the range around 1150° C. is the optimal hardening temperature for the alloy according to the invention. At this temperature and with a holding time of 2 min, sufficient secondary carbides are dissolved and the matrix is enriched with appropriate alloying elements so that a high-strength matrix is produced. The term "matrix" or "steel matrix" refers to the material surrounding the carbides. According to the invention, the high hardness and compressive strength are based not only on the carbides but also on the hard matrix. In addition, the balanced alloy composition means that at the hardening temperature according to the invention, the carbide content is significantly lower than in known steel grades. The subsequent tempering treatment is fine-tuned to the alloy composition according to the invention in such a way that the secondary hardening carbides that are produced from the solid phase during tempering are significantly smaller. The alloy composition according to the invention in combination with the heat treatment according to the invention thus succeeds in creating a high-strength steel matrix with a carbide content that simultaneously remains low. This results in a good combination of hardness, toughness, and compressive strength.

The invention thus relates to a method for producing a tool steel for cold-work and high-speed-work applications, wherein a steel material consisting of the following alloying elements: (all amounts expressed in wt %):

C=0.55 to 0.75
Si=0.70 to 1.00
Mn=0.20 to 0.60
Cr=4.00 to 5.00
Mo=1.80 to 3.50
V=0.80 to 1.50
W=1.80 to 3.00
Co=3.00 to 5.00
N=0.020 to 0.10 and optionally one or more of

Nickel (Ni)≤1.5
Copper (Cu)≤1.0
Titanium (Ti)≤1.5
Niobium (Nb)≤1.5
Tantalum (Ta)≤1.5
Hafnium (Hf)≤1.5
Zirconium (Zr)≤1.5
Aluminum (Al)≤1.5
Boron (B)≤0.8
Sulfur (S)≤0.35
Phosphorus (P)≤0.35 residual iron and inevitable smelting-related impurities is melted and processed into a powder by atomization and the powder is then hot isostatic pressed and the hot isostatic pressed powder is then optionally hot-formed and further processed, wherein this is followed by a heat treatment, the heat treatment being carried out in such a way that the steel material and/or the tool manufactured out of it is first heated to a hardening temperature of 1100° C.-1180° C., then kept at this hardening temperature for at most 2 to 20 minutes, and then cooled at a cooling rate of λ≤3 to a temperature ≤60° C., preferably ≤30° C., for hardening purposes, and then tempered, wherein the tempering treatment comprises at least two cycles in which the steel material is heated to a temperature of 530° C. to 560° C., kept at this temperature of 530° C. to 560° C. for at least two hours, and cooled to a temperature ≤60° C., preferably ≤30° C.

In an advantageous embodiment, three tempering cycles are performed.

In a further advantageous embodiment, the steel material contains at least one or more or all of the following element (s) with the following concentration value(s) (all amounts expressed in wt %):

C=0.58 to 0.68
Si=0.70 to 0.94
Mn=0.20 to 0.40
Cr=4.10 to 4.70
Mo=2.00 to 3.20
V=0.90 to 1.25
W=2.00 to 2.70
Co=3.50 to 4.30
N=0.03 to 0.08

Advantageously, the steel material is heated to a hardening temperature selected from the group of 1180° C., 1160° C., or 1100° C. and for a duration selected from the group of at most 2 minutes, at most 3 minutes, or at most 20 minutes, and then cooled to a temperature ≤60° C. for hardening purposes.

It is advantageous if the steel material is tempered, wherein the tempering treatment is carried out at a temperature selected from the group of 530° C., 550° C., or 560° C. for a duration selected from the group of at least 1.5, 2, 2.5, 3, or 3.5 hours, wherein at least two tempering cycles are performed and the steel material is preferably cooled to a temperature of ≤60° C. after each tempering cycle.

It is also advantageous if the steel material is cooled to a temperature of ≤30° C. after being heated to the hardening temperature and/or after each tempering step.

It is particularly advantageous if the steel material and/or the tool manufactured from it is heated to a hardening temperature of 1180° C. for at most 2 minutes, then cooled at a cooling rate of λ≤3 to a temperature ≤60° C., preferably ≤30° C., for hardening purposes, and then tempered, wherein the tempering treatment is carried out at a temperature of 560° C. for at least 2 hours, wherein at least two tempering cycles are performed and the steel material and/or the tool manufactured from it is preferably cooled to a temperature of ≤60° C., preferably ≤30° C., after each tempering cycle.

It is further advantageous if the steel material and/or the tool manufactured from it is heated to a hardening temperature of 1160° C. for at most 3 minutes, then cooled at a cooling rate of λ≤3 to a temperature ≤60° C., preferably ≤30° C., for hardening purposes, and then tempered, wherein the tempering treatment is carried out at a temperature of 530° C. for at least 2 hours, wherein at least two tempering cycles are performed and the steel material and/or the tool manufactured from it is preferably cooled to a temperature of ≤60° C., preferably ≤30° C., after each tempering cycle.

In a particularly advantageous embodiment, the steel material and/or the tool manufactured from it is heated to a hardening temperature of 1150° C. for at most 3 minutes, after which it is cooled at a cooling rate of λ≤3 to a temperature ≤60° C., preferably ≤30° C., for hardening purposes, and then tempered, wherein the tempering treatment is carried out at a temperature of 530° C. for at least 2 hours, wherein at least two tempering cycles are performed and the steel material and/or the tool manufactured from it is preferably cooled to a temperature of ≤60° C., preferably ≤30° C., after each tempering cycle.

In an advantageous embodiment, the steel material and/or the tool manufactured from it is heated to a hardening temperature of 1140° C. for at most 3 minutes, after which it is cooled at a cooling rate of λ≤3 to a temperature ≤60° C., preferably ≤30° C., for hardening purposes, and then tempered, wherein the tempering treatment is carried out at a temperature of 530° C. for at least 2 hours, wherein at least two tempering cycles are performed and the steel material and/or the tool manufactured from it is preferably cooled to a temperature of ≤60° C., preferably ≤30° C., after each tempering cycle.

In addition, it is advantageous if the steel material and/or the tool manufactured from it is heated to a hardening temperature of 1100° C. for at most 20 minutes, then cooled at a cooling rate of λ≤3 to a temperature ≤60° C., preferably ≤30° C., for hardening purposes, and then tempered, wherein the tempering treatment is carried out at a temperature of 530° C. for at least 2 hours, wherein at least two tempering cycles are performed and the steel material and/or the tool manufactured from it is preferably cooled to a temperature of ≤60° C., preferably ≤30° C., after each tempering cycle.

Advantageously, a steel matrix is created that comprises MC and $M_6C$ carbides to increase hardness and compressive strength, the MC carbides having an average diameter of 0.6 μm and the $M_6C$ carbides having an average diameter of 0.9 μm.

In one embodiment, a steel matrix is set, whereby the carbide density in the matrix is at most 27538 particles/mm$^2$ and at least of 12688 particles/mm$^2$ for $M_6C$ carbides and at most 39845 particles/mm$^2$ and at least 21093 particles/mm$^2$ for MC carbides. The particle density was determined by SEM examinations of a finely polished cross-section with 0.05 μm $Al_2O_3$ OPS on the basis of 20 different measuring points, each with: image section 43.1 μm×32.3 μm, image resolution 1024×768 pixels, 15 keV electron beam energy, 1 nA sample current, 100 μs dwell time per pixel.

In a further advantageous embodiment, a steel matrix is adjusted, whereby the average area fraction of the $M_6C$ carbides is at most 1.9% and the average area fraction of the MC carbides at most 1.3%. The area fraction was measured analogously to the particle density and determined by means of EDX element distribution.

Advantageously, a steel material is produced that has a hardness of at least 62 HRC, preferably at least 63 HRC, measured in accordance with ASTM E18-17.

It is also advantageous if a steel material is produced that has a toughness, measured as impact bending work at room temperature in accordance with SEP 1314, of at least 73 J.

In addition, it is advantageous if a steel material is produced that has a compressive strength, measured as the offset yield point Rp0.2, of ≥2700 MPa, preferably 2800 MPa, more preferably 2900 MPa, particularly preferably 2950 MPa.

In addition, the invention also relates to a tool steel for cold-work and high-speed-work applications, produced in particular according to the above method, wherein the steel material consists of the following alloying elements (all amounts expressed in wt %):

C=0.55 to 0.75
Si=0.70 to 1.00
Mn=0.20 to 0.60
Cr=4.00 to 5.00
Mo=1.80 to 3.50
V=0.80 to 1.50
W=1.80 to 3.00
Co=3.00 to 5.00
N=0.02 to 0.10 and optionally one or more of

Nickel (Ni)≤1.5
Copper (Cu)≤1.0
Titanium (Ti)≤1.5
Niobium (Nb)≤1.5
Tantalum (Ta)≤1.5
Hafnium (Hf)≤1.5
Zirconium (Zr)≤1.5
Aluminum (Al)≤1.5
Boron (B)≤0.8
Sulfur (S)≤0.35
Phosphorus (P)≤0.35 and residual iron and inevitable smelting-related impurities.

Advantageously, the carbon content in the steel alloy has an upper limit of 0.75 wt %, preferably 0.68 wt %, particularly preferably 0.63 wt %, and a lower limit of 0.55 wt %, preferably at 0.58 wt %, particularly preferably 0.55 wt %.

Also advantageously, the vanadium content in the steel alloy has an upper limit of 1.50 wt %, preferably 1.25 wt %, particularly preferably 1.12 wt %, and a lower limit of 0.80 wt %, preferably 0.90 wt %.

It is also advantageous if the cobalt content in the steel alloy has an upper limit of 5.00 wt %, preferably 4.30 wt %, particularly preferably 3.70 wt %, and a lower limit of 3.00 wt %, preferably 3.50 wt %.

In one embodiment, the steel material and/or the tool manufactured from it is hardened at 1100-1180° C. for at most 2 to 20 minutes and cooled at a cooling rate of $\lambda \leq 3$ to a temperature of ≤60° C., preferably ≤30° C.

It is advantageous if the steel material and/or the tool manufactured from it is tempered at 530-560° C. for at least 2 hours with at least two tempering cycles.

The tool steel can be used as a support for a PVD coating.

In addition, the tool steel can be used for a stamping or fine blanking tool.

BRIEF DESCRIPTION OF THE DRAWINGS

The invention will be explained by way of example with the aid of the drawings. In the drawings:

FIG. 7: shows a heat treatment according to the invention;

FIG. 8: shows the fractions of MC and $M_6C$ carbides at different hardening temperatures;

FIG. 9: shows the carbide contents at a hardening temperature of 1150° C.;

FIG. 15: shows the results for compressive strength;

FIG. 16: shows examples of steel compositions according to the invention, heat treatments, and the resulting hardness, toughness, and compressive strength;

FIG. 17: shows examples of steel compositions not according to the invention;

DETAILED DESCRIPTION OF THE INVENTION

Figures 1, 2, 3:
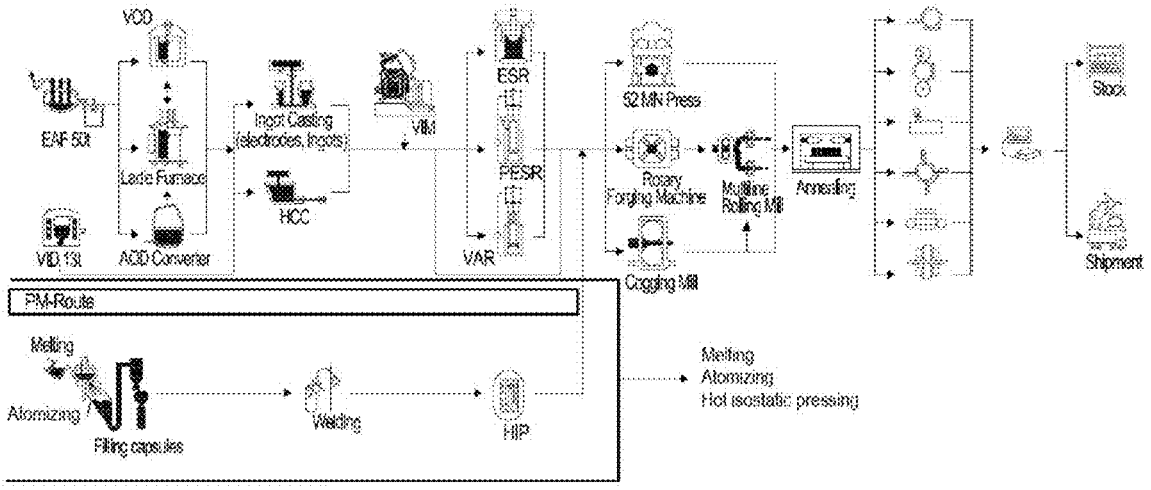
FIG. 1: shows the possible steel compositions according to the invention.
FIG. 2: is a comparison table showing two known steel materials and the material according to the invention.
FIG. 3: is a very schematic depiction of a manufacturing route; the powder metallurgy PM route is according to the invention.

FIG. 1 shows the analysis range within which the invention can be implemented and the effects according to the invention are achieved.

FIG. 2 shows the composition of the steel material according to the invention, which is in the range of the composition according to FIG. 1 and shows one embodiment of the steel material. Two other embodiments, namely REF 1 (EP3050986) and REF 2 (EP1469094), are compared to this steel material in which the silicon, molybdenum and cobalt contents are significantly increased compared with the known embodiments and the nickel content in particular differs considerably and in particular, is reduced.

Compared to known alloys in the prior art, a very narrow selection is pursued, which reliably ensures the effects according to the invention, particularly with the heat treatment according to the invention.

FIG. 3 shows a conventional melting metallurgy manufacturing route (not according to the invention), the possible powder metallurgy manufacturing route for producing the powder (according to the invention), and corresponding articles produced thereby.

After the feedstock is melted and the desired composition is set, a corresponding steel melt is atomized, particularly with nitrogen or other inert gases, to form a powder. If necessary, this powder is graded by screening or sieving, and the graded powder is then assembled into a desired grain band, dispensed into a corresponding capsule, which is welded and then compacted by hot isostatic pressing. Correspondingly, a material that is transformed in this way can then be fed into the hot forming process.

In particular, the dense and homogeneous material produced by the hot isostatic pressing can be rolled or forged to the required dimensions in a forming process. The thickness after the hot rolling can, for example, be 60 mm, which corresponds to a forming degree of 7 times the diameter reduction.

Segregation occurs in steel materials that contain segregation-active elements and are produced by the conventional casting process. In the segregation zones, there is often an imbalance of element concentrations. This can result in the formation of primary carbides even though primary carbide formation would not be expected based on the alloy composition in thermodynamic equilibrium. The powder metallurgy manufacturing route has the advantage of hindering the occurrence of segregation zones and thus the formation of primary carbides.

The production parameters during atomization of the molten steel have a significant influence on the powder grain size and thus on the carbide grain size. Fine adjustment of the setting parameters of temperature and pressures is also necessary in the HIP process to prevent carbide growth or the formation of carbide clusters. Especially in the case of such high-alloy steels as in the subject matter of the invention, high carbide contents are often present. Carbides have a positive effect on compressive strength and on hardness in general. But when it comes to toughness, compressive strength, and fatigue strength, carbides constitute "imperfections" that limit these properties. In this respect, it is particularly important to have small, round carbides that are homogeneously distributed over the cross-section. Due to the high number of carbides, it often happens with such high-alloy steels that the carbides conglomerate during the conventional casting process, which can severely limit the toughness and fatigue strength and, subsequently, also the service life of the tool that is produced from it. In the present subject matter according to the invention, fine singular carbides are present.

In particular, these are the so-called secondary hardening carbides of the MC and $M_6C$ types, which are produced from the solid phase during a tempering treatment. The secondary carbides usually have a smaller particle size compared to primary carbides precipitated from the melt.

Figure 4:
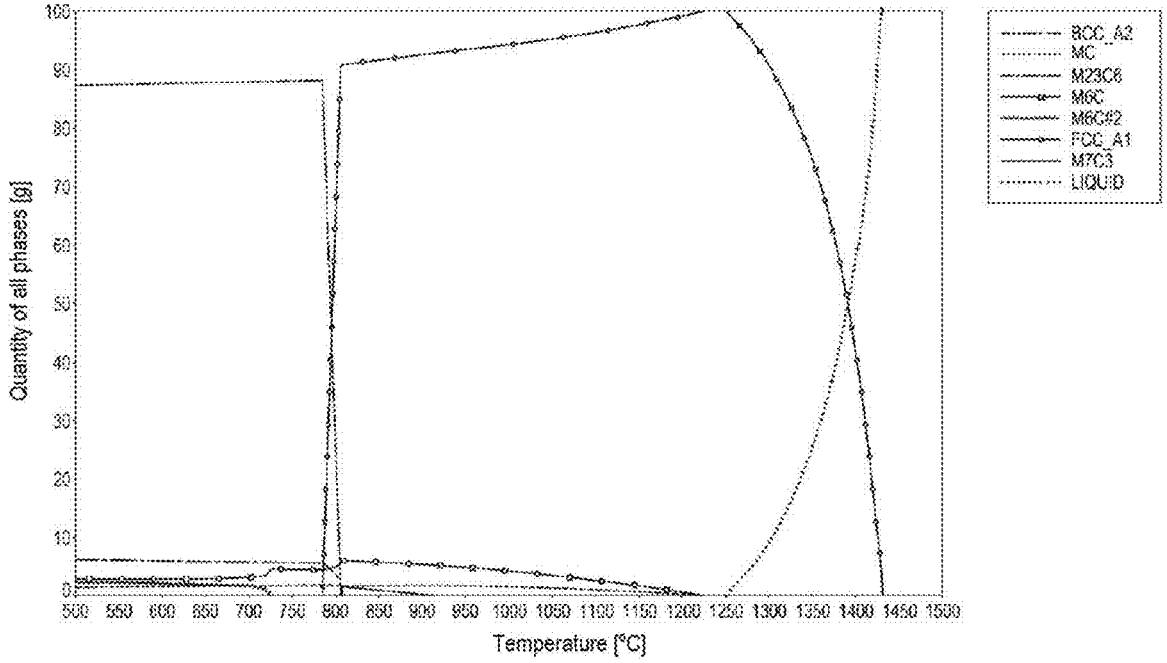
FIG. 4: shows a thermodynamic stability calculation for different carbide phases.

A thermodynamic stability calculation using Thermo-Calc for various carbide phases is shown in FIG. 4. The calculation shows which carbide phases are in equilibrium or are thermodynamically stable at a certain temperature. This is necessary for establishing the hardening temperature at which sufficient solubility of the carbide phases is present. Carbides of the $M_{23}C_6$ and $M_7C_3$ types dissolve completely in the matrix during hardening; carbides of MC and $M_6C$ types dissolve to a large extent but not completely. Complete solubility of the carbides is not desired, however, so the maximum hardening temperature is limited to 1180° C. A certain amount of carbides should be retained in the structure during hardening to prevent a coarsening of the grains. This can be explained by the fact that carbides function like growth retardants and slow the unwanted grain growth.

It is clear that most carbide phases are not thermodynamically stable at 1100° C., particularly at 1150° C., and decompose. But if the temperature falls below 1100° C., too few alloying elements are dissolved in the matrix. This leads to a reduced hardness level. In addition, a hardness temperature that is too low results in an increased carbide content in the alloy composition according to the invention. In other words, at a lower hardening temperature, the secondary carbide volume is higher because fewer secondary carbides dissolve in the matrix. Higher temperatures and longer holding times result in a lower carbide volume. In the temperature range around 1100° C., the holding time is therefore 20 min.

The maximum hardening temperature at which the effects according to the invention can still be achieved is 1180° C. If the temperature is exceeded, then more carbon and carbide formers are dissolved in the matrix. This increases the hardness of the steel material, but leads to a significant reduction in toughness. In this connection, it is particularly important to adhere to the holding time, which must not exceed 2 min in the temperature range around 1180° C. Longer holding times increase the carbide growth at this temperature.

It has turned out that the temperature range around 1140-1160° C. is particularly advantageous and results in a balanced combination of hardness and toughness properties. The optimum holding time here is at most 3 min.

The lower limit for the hardening temperature according to the invention is therefore 1100° C., in particular 1150° C. The upper temperature limit at which the effects according to the invention can also be achieved is 1180° C.

Figure 5:
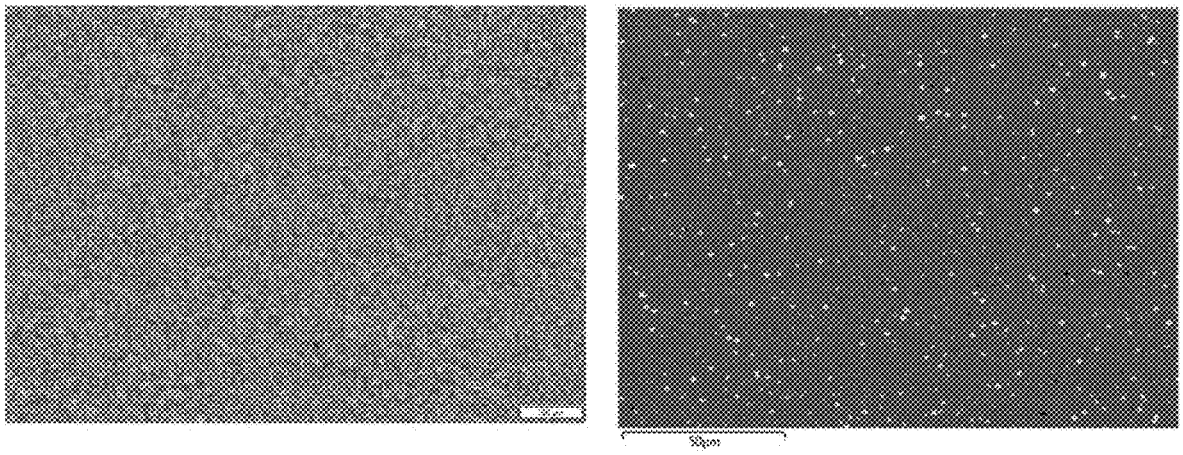
FIG. 5: shows SEM images of a cross-section of a steel material hardened at 1150° C. according to the invention.

This is clearly evident in FIG. 5. A steel surface hardened at 1150° C. and then heat-treated according to the invention exhibits fine, singular, finely distributed carbides. No segregations, carbide agglomerates, or inhomogeneities are discernible in the structure.

Figure 6:
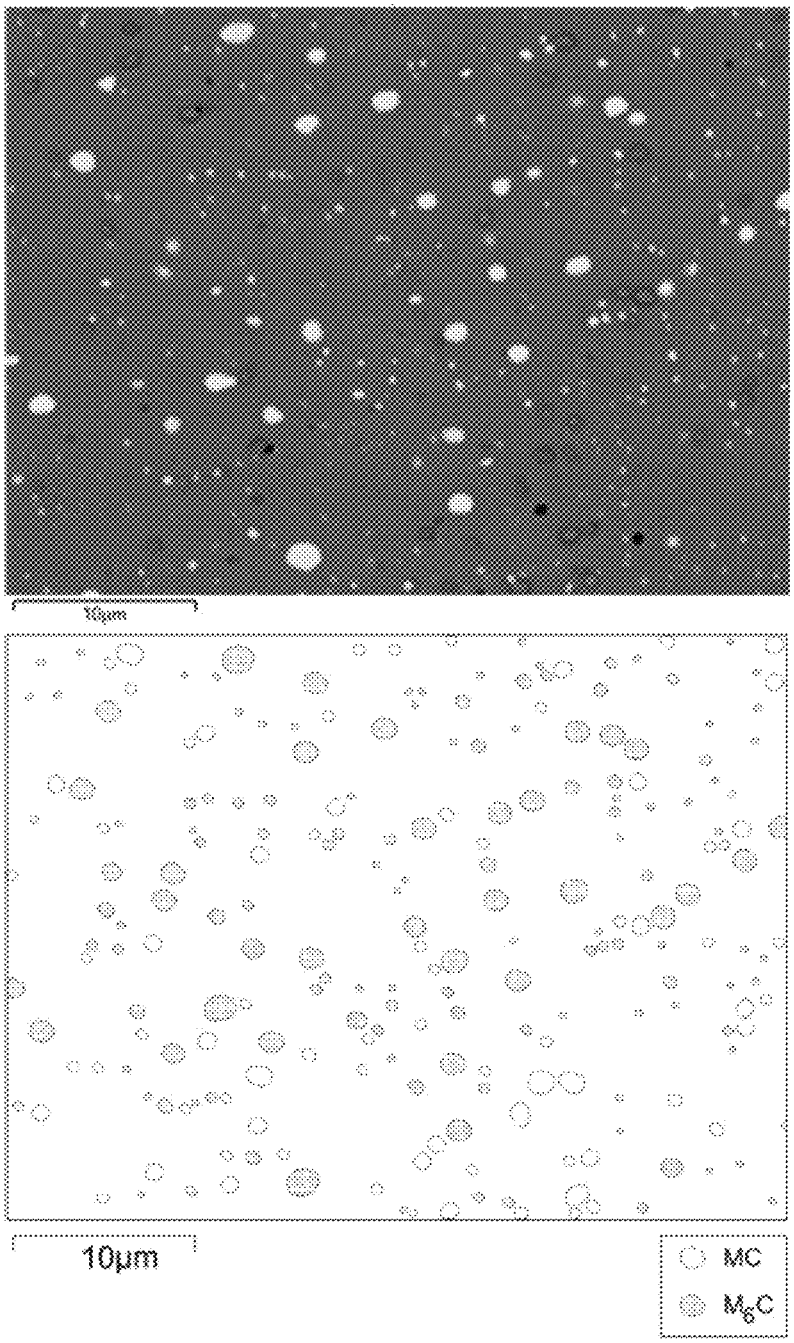
FIG. 6: shows another SEM image of a cross-section showing the $M_6C$ and MC carbides of the material.

With the alloy composition according to the invention, particularly in combination with the heat treatment according to the invention, the carbide phase distribution is especially homogeneous (FIG. 6). The carbides, particularly of the MC and $M_6C$ types, are round and uniformly distributed in the steel matrix. No carbide conglomerates are present. No large primary carbides are present either.

A finely tuned heat treatment has significant influence on the size, the homogeneous distribution, and finally the area fraction of the carbides. Since the secondary carbides are precipitated from the solid phase, a fine adjustment of the holding time and subsequent tempering treatment to match the respective hardening temperature is required.

The temperature range between 530° C. and 560° C. has proved to be particularly advantageous for a tempering treatment in the case of the alloy composition according to the invention. But if the temperature of 560° C. is exceeded, the hardness level is reduced too much. If the temperature falls below 530° C., then the toughness is significantly reduced. In addition, this leads to an increased proportion of retained austenite, which cannot be completely eliminated even after a three-stage tempering treatment. Consequently, the upper limit for the tempering treatment is 560° C. and the lower limit is 530° C.

FIG. 7 shows hardening and tempering treatments according to the invention. In one embodiment according to the invention, the steel material and/or the tool made from it is hardened at a temperature of 1180° C. for at most 2 min and then rapidly cooled to ≤30° C. at a cooling rate of $\lambda \leq 3$ (FIG. 7). Here, $\lambda$ values are used to define cooling rates and denote the time required to cool a steel from 800° C. to 500° C., in units of hectoseconds. Thus, $\lambda=3$ means that cooling from 800 to 500° C. takes about 3 hs=300 s=5 min.

It is essential to keep the temperature below the 30° C. limit since this reduces the amount of retained austenite. Any remaining retained austenite can severely harm the mechanical properties. It can also result in tool failure. This can be explained by a structural transformation during operation, which is accompanied by a change in volume and dimensions. To prevent this, the steel is tempered two or three times at 560° C. for 120 min each time. After each tempering cycle, the steel material is preferably cooled to ≤30° C.

In the course of this, the proportion of retained austenite is significantly reduced after each hardening and tempering cycle composed of heating, holding, and cooling. Depending on the desired minimum retained austenite content, up to three tempering cycles can be provided since with each additional tempering cycle, an additional percentage of the retained austenite flips over into the desired martensite. The lowest possible proportion of retained austenite is so advantageous because it transforms when subjected to a load and because the corresponding part, e.g. a punch, can then be susceptible to brittle fracture.

To ensure this transformation of the retained austenite into martensite, cooling to ≤60° C., preferably ≤30° C., is required after each hardening cycle and advantageously after each tempering cycle.

In a further embodiment, the steel material and/or the tool made from it is hardened at 1160° C. for at most 3 min. It is then cooled to ≤30° C. during which $\lambda$ values≤3 are maintained. After the cooling, the steel material is tempered two or three times at 560° C. for 120 min each time. After each tempering cycle, the steel material is preferably cooled to ≤30° C.

In a particularly advantageous embodiment, the steel and/or the tool made from it is hardened at a temperature of 1150° C. for at most 3 min and then cooled to ≤30° C. Then the steel is tempered two or three times at 530° C. for 120 min each time. After each tempering cycle, the steel material is preferably cooled to ≤30° C.

Advantageously, the steel and/or the tool made from it is hardened at 1140° C. for at most 3 min. It is then cooled to ≤30° C. and tempered two or three times at 530° C. for 120 min each time. After each tempering cycle, the steel is preferably cooled to ≤30° C.

It is also advantageous if the steel material and/or the tool made from it is hardened at 1100° C. for at most 20 min and then cooled to ≤30° C. The steel material is then subjected to a tempering treatment of two or three tempering cycles at 530° C. for 120 min each time. After each tempering cycle, the steel is preferably cooled to ≤30° C.

The tempering treatment according to the invention provides for the tempering to be carried out immediately after the hardening for at least 2 hours for each tempering cycle, with the furnace being set to the tempering temperature as the set point. Direct heating to this set point is carried out, this being done in a nitrogen atmosphere. In each cycle, heating to the set point temperature is performed for 2 hours and then the heating is switched off while the nitrogen atmosphere remains. The final temperature is below 30° C. and when it is reached the next cycle is started. Two or three tempering cycles are performed. It is of course possible to carry out each tempering cycle differently with regard to the tempering temperature or heating and cooling rates, but it can be perfectly advantageous to carry out each tempering cycle in an identical fashion.

The resulting carbide content varies depending on the heat treatment and in particular on the hardening temperature used because in the course of this, elements are dissolved that are required for the formation of the secondary hardening carbides that are produced later. But it is advantageous if a certain amount of secondary carbides is retained in the structure. This slows down grain growth and thus hinders a coarsening of the grains.

Figure 12:
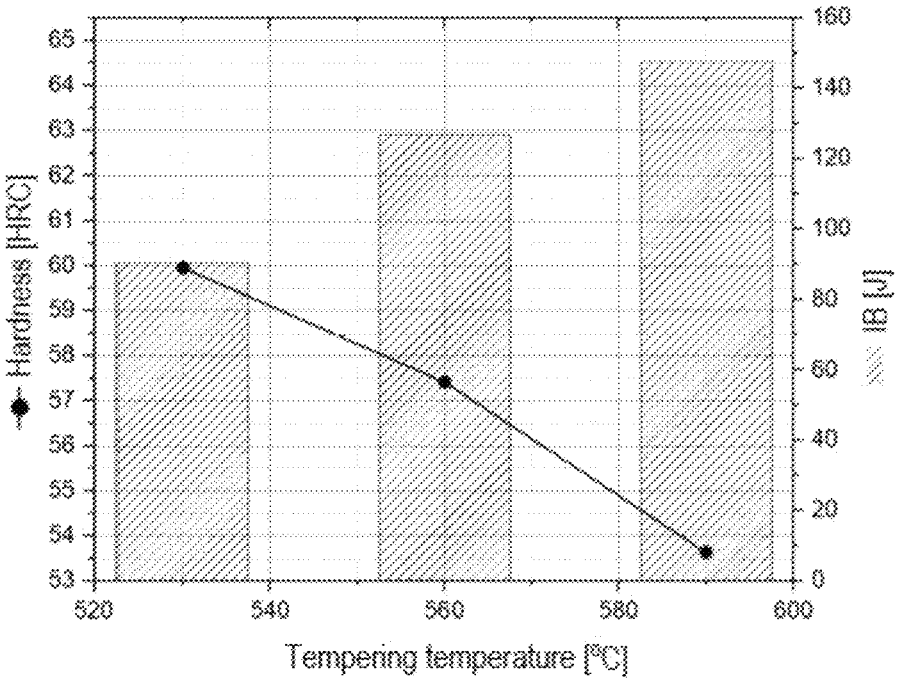
FIG. 12: shows the hardness and impact bending work (IB) as a function of tempering temperature (not according to the invention) for a hardening temperature of 1030° C.
Figure 13:
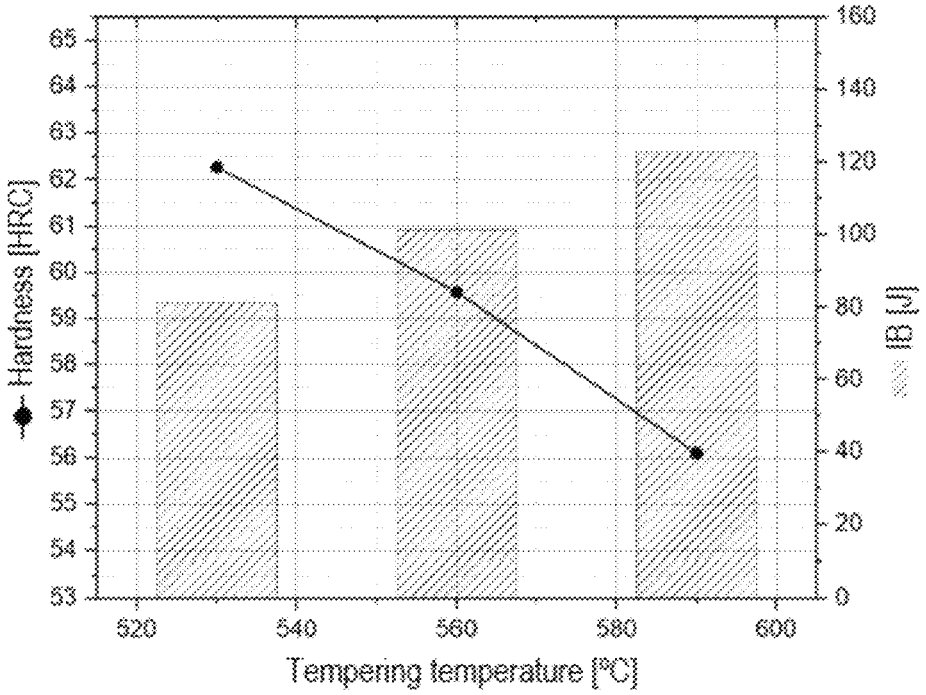
FIG. 13: shows the hardness and impact bending work (IB) as a function of tempering temperature (not according to the invention) for a hardening temperature of 1070° C.
Figure 14:
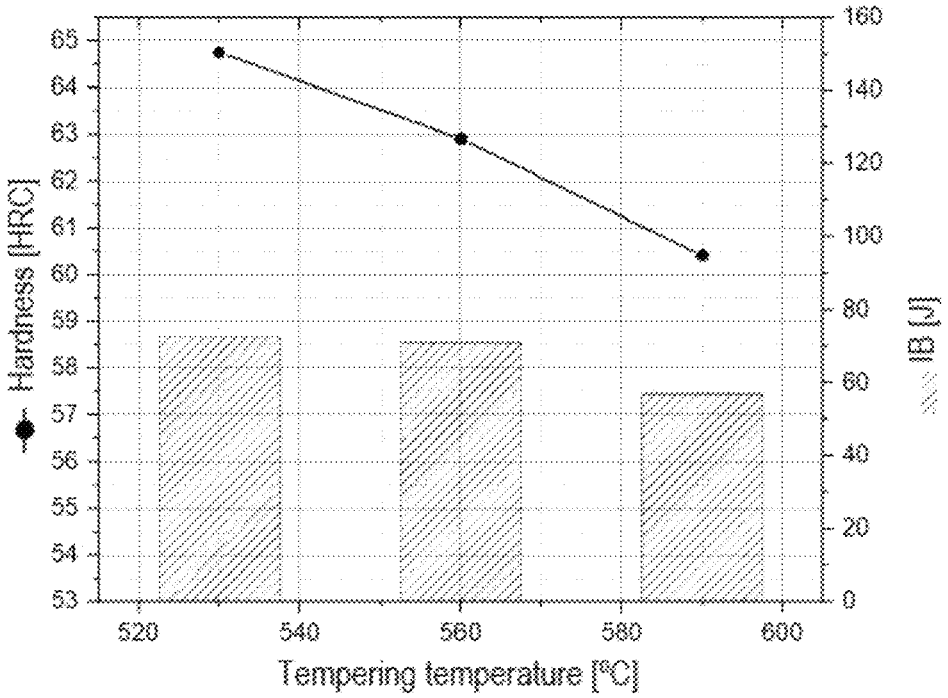
FIG. 14: shows the hardness and impact bending work (IB) as a function of tempering temperature (according to the invention) for a hardening temperature of 1150° C.

The invention will be further explained based on an example:

Three specimens of an alloy according to the invention are hardened at 1070° C. (FIG. 13, not according to the invention), 1150° C. (FIG. 14, according to the invention), and 1030° C. (FIG. 12, not according to the invention), quenched with $\lambda$=0.35, and tempered at 530° C. (according to the invention), 560° C. (according to the invention), or 590° C. (not according to the invention). The hardening not according to the invention results in lower hardness levels, and tempering not according to the invention results in reduced hardness and toughness. Then the area fraction of MC and $M_6C$ carbides is determined (FIG. 8). The specimens for which the hardening temperature according to the invention is not maintained contain a higher carbide content while the specimen hardened at 1150° C. has the lowest carbide content.

The specimen hardened at 1070° C. contains 1.59% MC carbides and 2.62% $M_6C$ carbides. Hardening at 1030° C. results in 1.51% MC carbides and 3.43% $M_6C$ carbides. The lowest carbide content is obtained for the specimen hardened at 1150° C. and correspondingly results in 1.33% for MC carbides and 2.45% for $M_6C$ carbides. The results demonstrate that the desired low carbide content can only be achieved in the narrow temperature window according to the invention. The carbide content is expressed as an area fraction.

Figure 10:
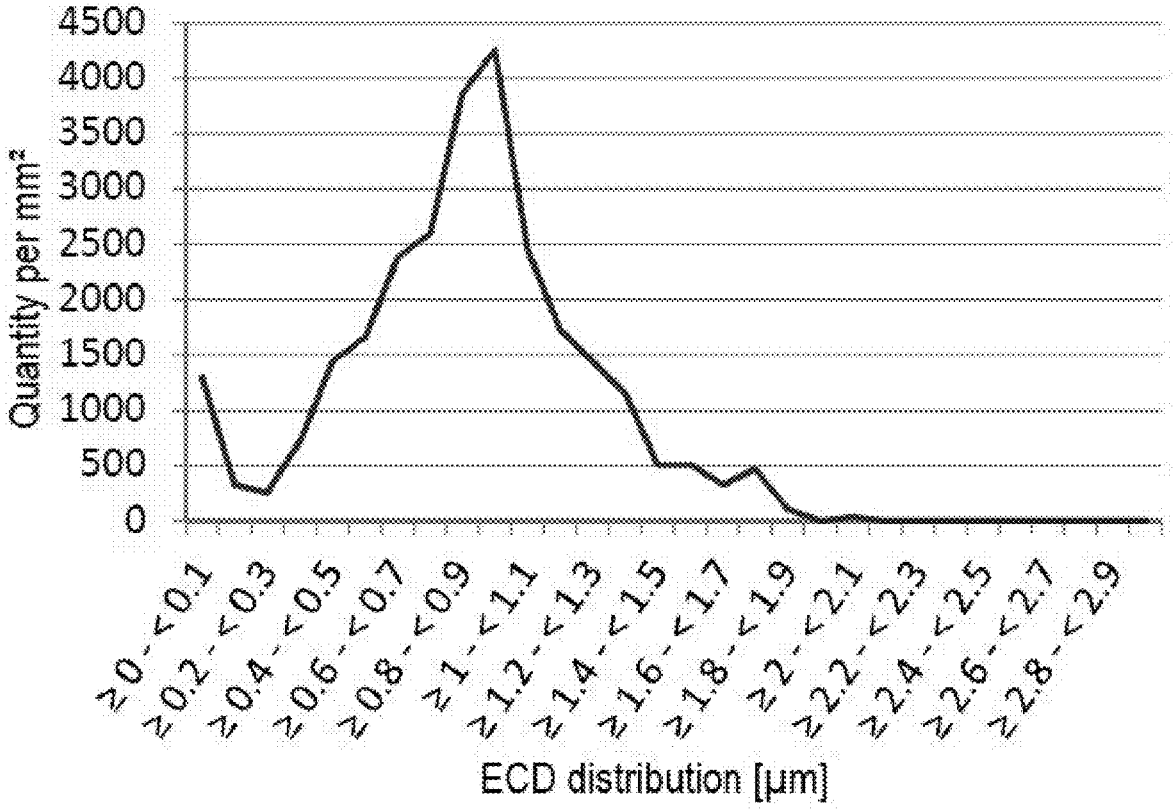
FIG. 10: shows the size distribution of $M_6C$ carbides.
Figure 11:
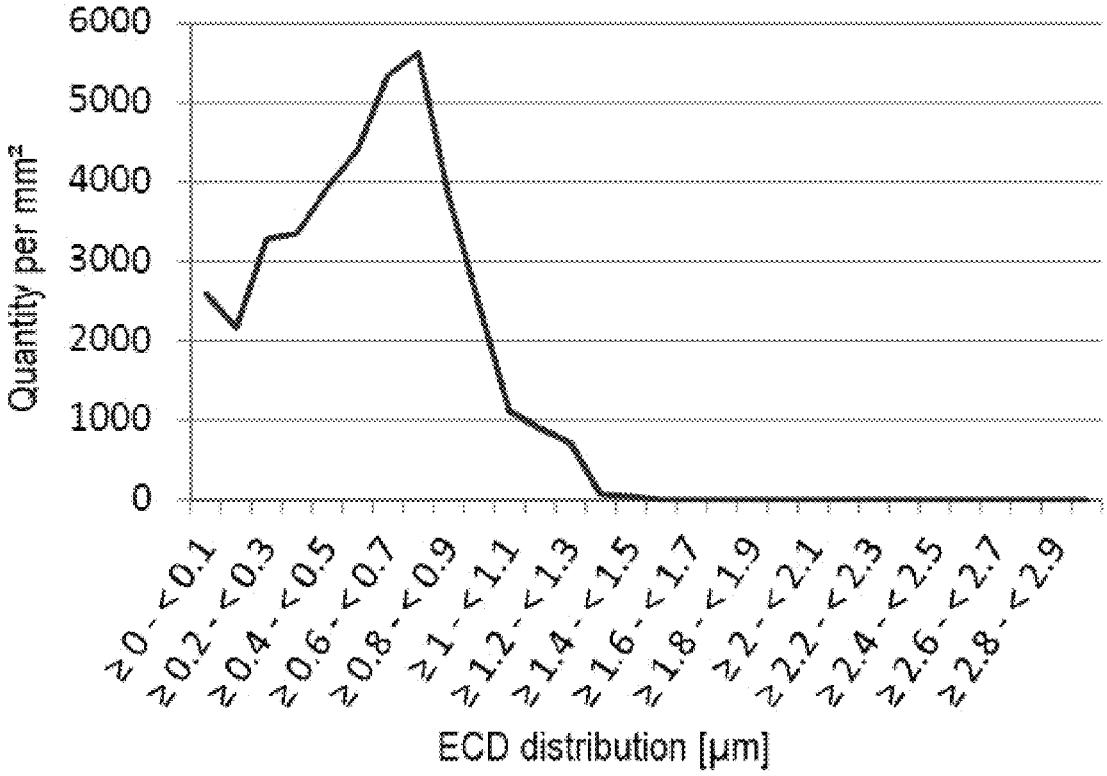
FIG. 11: shows the size distribution of MC carbides.

According to the invention, the vanadium-rich MC carbides have a maximum size of 1.5 μm and the tungsten-rich and molybdenum-rich $M_6C$ carbides have a maximum size of 2.1 μm. The average diameter of the small MC carbides is 0.6 μm, while the average diameter of the larger $M_6C$ carbides is 0.9 μm (FIG. 9). The size distribution of the MC carbides and $M_6C$ carbides is shown in FIGS. 10 and 11. The carbide size is expressed as ECD (equivalent circle diameter).

It is advantageous if the carbide density in the matrix is at most 27538 particles/mm$^2$ for $M_6C$ carbides and at most 39845 particles/mm$^2$ for MC carbides. Accordingly, it is advantageous if the average area fraction of the large $M_6C$ carbides is at most 1.9% and the average area fraction of the small MC carbides at most 1.3%.

The alloy composition according to the invention and the heat treatment fine-tuned to it are used to create a steel material and/or a tool made from it, which has a high compressive strength. Offset yield points Rp0.2 of more than 2950 MPa can be achieved at a hardness level of 64 to 65 HRC. FIG. 15 shows the results of the uniaxial compression test with the modulus of elasticity (E), the 0.05% offset yield point at 0.05% deformation (Rp0.05), the 0.01% offset yield point at 0.1% deformation (Rp0.1), and the offset yield point at 0.2% deformation (Rp0.2). The specimens are measured at room temperature with a test speed of 0.00025 RPS. The specimens are of the LCF type with a shortened shank and have a diameter of 9 mm and an initial gauge length ($L_0$) of 12 mm (measured with an Instron 8854 servo-hydraulic testing machine with a 250 kN load cell).

FIG. 16 shows various powder metallurgy-produced steels according to the invention, heat treatments and resulting hardness in HRC, toughness in the form of impact bending energy (IB) in joules, and offset yield point Rp0.2 in MPa FIG. 17 shows various steel compositions not according to the invention which have been processed with a heat treatment consisting of hardening and tempering and the resulting hardness, toughness, and offset yield point.

Figure 18:
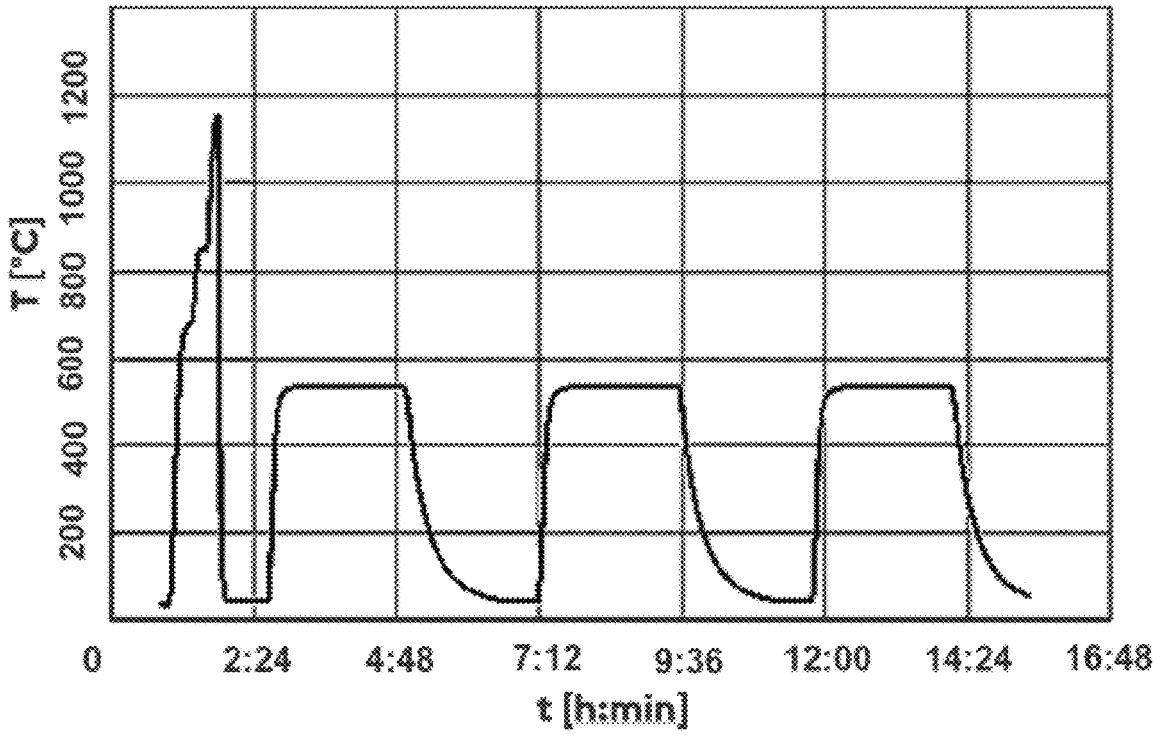
FIG. 18: shows a sample heat treatment consisting of hardening and tempering.

FIG. 18 shows an exemplary heat treatment consisting of hardening and 3 tempering cycles. In this embodiment, before the hardening temperature of 1150° C. is reached, two holding points are established, the first at 690° C. and the second at 850° C. These ensure that the steel material is heated through.

With the alloy according to the invention and the heat treatment finely tuned to it, a 15 to 20% increase in fatigue strength can be expected compared with other powder metallurgy-produced cold-work steels of identical hardness (62-65 HRC, fatigue strength approx. 950 to 1050 MPa)

The alloy composition and heat treatment according to the invention succeed in creating a steel material with an outstanding combination of hardness and toughness. The material according to the invention possesses exceptionally good toughness at a very high hardness so that it has been possible to successfully reconcile two competing mechanical properties.

With the invention, it is advantageous that the hardness-toughness advantage can be achieved, particularly at the specified hardening temperature of approximately 1150° C., if the specified heat treatment cycle is adhered to. At the above-mentioned hardening temperature, a hardness of 65 HRC and toughness of 73 J can be achieved. It is true that even slight deviations in the hardening temperature downward or upward cannot be ruled out, but the significant hardness-toughness advantages compared to the prior art are no longer assured to the same extent. At temperatures above 1180° C., there is a risk that instances of initial melting can already occur in the material, which is also undesirable.

With the invention, it is advantageous that the method according to the invention makes it possible to very reliably achieve mechanical properties that were previously incompatible with one another in this form. In particular, very high hardness values of over 62 HRC are achieved with toughnesses of 70-90 J or more (measured as impact bending work at room temperature in accordance with SEP 1314), which were previously not reliably achievable in this range with these materials in this form. For this purpose, it is necessary to reliably adhere to this narrow selection.

In addition, a high compressive strength, which is measured as the offset yield point Rp0.2, of over 2700 MPa is achieved at a hardness level of 62-65 HRC. Such a steel material is outstandingly suitable as a support material for PVD coatings, in particular hard coatings, and for the manufacture of high-strength tools, especially stamping and fine blanking tools.

The invention claimed is:

1. A method for manufacturing a tool steel for use in coating applications, comprising melting and processing into a powder by atomization a steel material consisting of the following alloy elements: (all amounts expressed in wt %):

C=0.55 to 0.75
Si=0.70 to 1.00
Mn=0.20 to 0.50
Cr=4.00 to 5.00
Mo=1.80 to 3.50
V=0.80 to 1.50
W=1.80 to 3.00
Co=3.00 to 5.00
N=0.02 to 0.10
and optionally one or more of
Ni≤1.5
Cu≤1.0
Ti≤1.5
Nb≤1.5
Ta≤1.5
Hf≤1.5
Zr≤1.5
Al≤1.5
B≤0.8
S≤0.35
P≤0.35
and residual iron and inevitable smelting-related impurities, the powder is then hot isostatic pressed, and the steel material thus produced is optionally subjected to a hot forming, wherein the steel material is subjected to heat treatment, the heat treatment being carried out in such a way that the steel material is first heated to a hardening temperature of 1180° C., then kept at this hardening temperature for at most 2 minutes, and then cooled to a temperature ≤60° C. at a cooling rate of λ≤3 for hardening purposes, and then tempered, wherein the tempering treatment comprises at least two cycles in which the steel material is heated to a temperature of 530° C. to 560° C., kept at this temperature of 530° C. to 560° C. for at least 1.5 hours, and then cooled to a temperature ≤60° C.

2. The method according to claim 1, wherein the steel material, which contains at least one or more or all of the element(s) with the following concentration value(s) (all amounts expressed in wt %):

C=0.58 to 0.68
Si=0.70 to 0.94
Mn=0.20 to 0.40
Cr=4.10 to 4.70
Mo=2.00 to 3.20
V=0.90 to 1.25
W=2.00 to 2.70
Co=3.50 to 4.30
N=0.03 to 0.08
is melted.

3. The method according to claim 1, wherein the steel material is tempered, wherein the tempering treatment is carried out at a temperature selected from the group consisting of 530° C., 550° C., or 560° C. for a duration selected from the group consisting of at least 1.5, 2, 2.5, 3, or 3.5 hours, wherein at least two tempering cycles are performed and the steel material is cooled to a temperature of ≤60° C. after each tempering cycle.

4. The method according to claim 1, wherein the steel material is cooled to a temperature of ≤30° C. after being heated to the hardening temperature and/or after each tempering step.

5. The method according to claim 1, wherein the heat treatment produces a steel material that has a compressive strength, measured as an offset yield point Rp0.2, of ≥2700 MPa.

* * * * *